United States Patent [19]

Streit et al.

[11] 3,946,303

[45] Mar. 23, 1976

[54] MONOLITHIC INTEGRATED VOLTAGE REGULATOR

[75] Inventors: Klaus Streit, Tubingen; Karl Staiger, Wannweil, both of Germany

[73] Assignee: Robert Bosch GmbH, Stuttgart, Germany

[22] Filed: Apr. 18, 1974

[21] Appl. No.: 461,932

[30] Foreign Application Priority Data

Apr. 28, 1973 Germany ..... 2321662

[52] U.S. Cl. ..... 323/22 T; 323/1

[51] Int. Cl.[2] ..... G05F 1/56

[58] Field of Search ..... 307/296, 297, 299 B; 323/1, 4, 16, 19, 22 T; 330/19, 22, 30 D, 38 M, 69

[56] References Cited

UNITED STATES PATENTS

| | | | |
|---|---|---|---|
| 3,555,402 | 1/1971 | Bozarth et al. | 323/4 |
| 3,588,672 | 6/1971 | Wilson | 323/4 |
| 3,649,926 | 3/1972 | Hill | 330/69 X |
| 3,714,600 | 1/1973 | Kuijk et al. | 330/19 X |
| 3,761,787 | 9/1973 | Davis et al. | 330/30 D |
| 3,781,699 | 12/1973 | Sakamoto | 330/69 X |
| 3,786,344 | 1/1974 | Davis et al. | 323/22 T |
| 3,792,365 | 2/1974 | Ellbogen | 330/19 X |
| 3,840,819 | 10/1974 | Steckler | 330/22 X |

*Primary Examiner*—A. D. Pellinen
*Attorney, Agent, or Firm*—William R. Woodward

[57] ABSTRACT

A voltage regulator of the type suitable for production as a monolithic integrated circuit for use with a separate reference voltage source is composed of a differential amplifier having a so-called current mirror circuit coupling its outputs, followed by a current amplifying circuit from the output of which a feedback voltage obtained from a resistive divider is brought back to one input of the differential amplifier, the other input thereof being for connection to the reference voltage source. Stabilization of the regulator is obtained by connecting a small capacitance, of a magnitude suitable for provision as an element of a monolithic integrated circuit, between one of the poles of the supply voltage and the point of connection between the differential amplifier and the current amplifier circuit. The differential amplifier has a current source between common emitter connection and ground. The stability condition is worked out showing that the sum current of the differential amplifier must be unusually small. When a multi-transistor current amplifier is used, a second small capacitance is connected in to improve performance. The capacitances may be base-collector diodes, base-emitter diodes, MOS elements, or the like.

16 Claims, 17 Drawing Figures

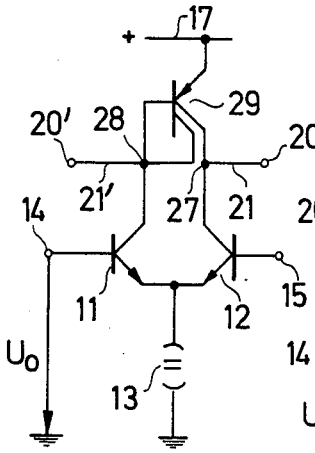
Fig. 3a
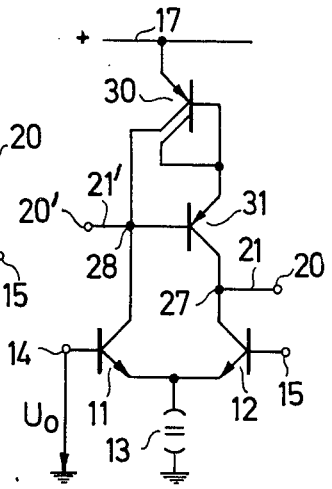
Fig. 3b
Fig. 4a
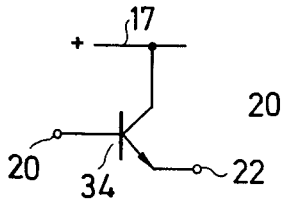
Fig. 4b
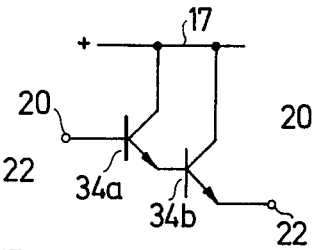
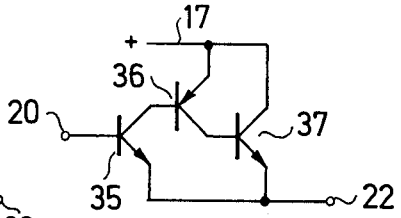
Fig. 4c
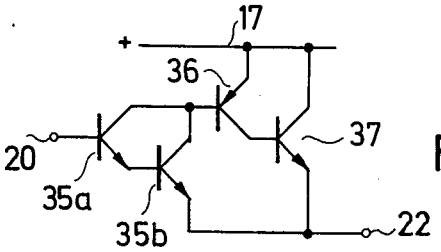
Fig. 4d
Fig. 5a
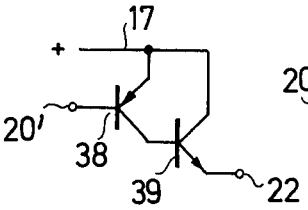
Fig. 5b
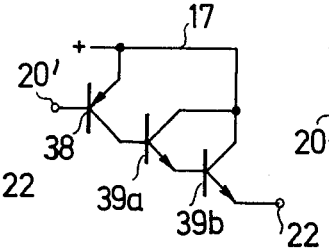
Fig. 5c
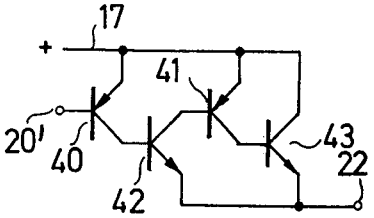

MONOLITHIC INTEGRATED VOLTAGE REGULATOR

The invention relates to a voltage regulator in the form of a monolithic integrated circuit.

A voltage regulator of monolithic integrated circuit construction is already known in the form of a voltage stabilizer circuit containing a reference voltage source and a regulator as an inseparable single unit. There is a need, however, for a monolithic integrated voltage regulator suitable for working with a separate source of reference voltage. This requires a stabilizing capacitor for the frequency characteristic of loop gain, but circuits heretofore known will not provide practical circuits with values of this capacitor small enough to be made part of an integrated circuit.

It is an object of the present invention to provide a monolithic integrated voltage regulator usable with a source of reference voltage provided as a separate circuit unit and therefore subject to be constituted in various desired ways, according to the particular requirements of different situations, such as temperature stability and the like.

SUBJECT MATTER OF THE PRESENT INVENTION

Briefly, a differential amplifier operated with an extremely small sum current is arranged to have its complementary outputs coupled by a current mirror circuit, and one of these outputs is connected to the input of a current amplifier circuit of very high current gain at the output terminal of which the stabilized output voltage of the regulator is available. The reference voltage source is connected to one input of the differential amplifier, and a feedback voltage taken from a resistive voltage divider across the output of the current amplifier circuit is provided to the other input of the differential amplifier. Only because of the extraordinarily low sum current of the differential amplifier provided in accordance with the invention can the frequency response characteristic of the regulator be adequately modified consistently with stability by the provision of a capacitor of electrical magnitude small enough for integration of this circuit element into the monolithic circuit, for example about 20 picofarads, connected between the junction of the input of the current amplifier circuit and the output of the differential amplifier, on one hand, and, on the other hand, a fixed voltage, preferably one of the terminals of the voltage supply to the integrated circuit.

The current mirror circuit may typically use a PNP transistor having two collectors, with its emitter connected to the positive voltage supply, one collector connected to the collector of one of the transistors of the differential amplifier and the other collector and the base being connected together and connected also either directly or through another PNP transistor to the collector of the transistor on the other side of the differential amplifier, the base of the second PNP transistor in that case being connected to that one of the two collectors of the first PNP transistor that is not connected to the base thereof. When the current mirror circuit is constituted as aforesaid, the differential amplifier utilizes NPN transistors, for example, a single pair with their emitters connected together and connected over a d.c. current source to the negative voltage supply terminal. The current source is preferably a transistor connected as a constant current source. The current mirror and differential amplifier combination has a very low steepness characteristic because of the extremely low sum current of the differential amplifier, a circumstance which results in requiring correspondingly higher current amplification by the following current amplification stage.

The differential amplifier can also be constituted in a form utilizing four NPN transistors, with a second pair in cascade with the first, with their bases connected together, and with the common base connection of these two transistors providing the input to the differential amplifier which is connected to the source of reference voltage.

Which output of the differential amplifier is connected to the input of the current amplifier circuit depends upon whether the current amplifier circuit has a current inflow input or a current outflow input, and the input assignments are correspondingly interchanged so that the proper phasing of the feedback is provided in each case.

In a specially improved embodiment of the invention the output stage of the current amplifier circuit utilizes two complementary transistors in the equivalent of a Darlington circuit, sometimes referred to as a Lin circuit, and the base of the first of these transistors is additionally coupled to the base of the second through a second capacitor, with or without a series resistor, this capacitor also being of a magnitude suitable for its provision as an integrated circuit element.

Further details, including the criteria by which the circuits of regulators of this invention are found to be realizable are given in the following detailed description, in which the invention is described by way of example with reference to the accompanying drawings, in which.

Figure 1:
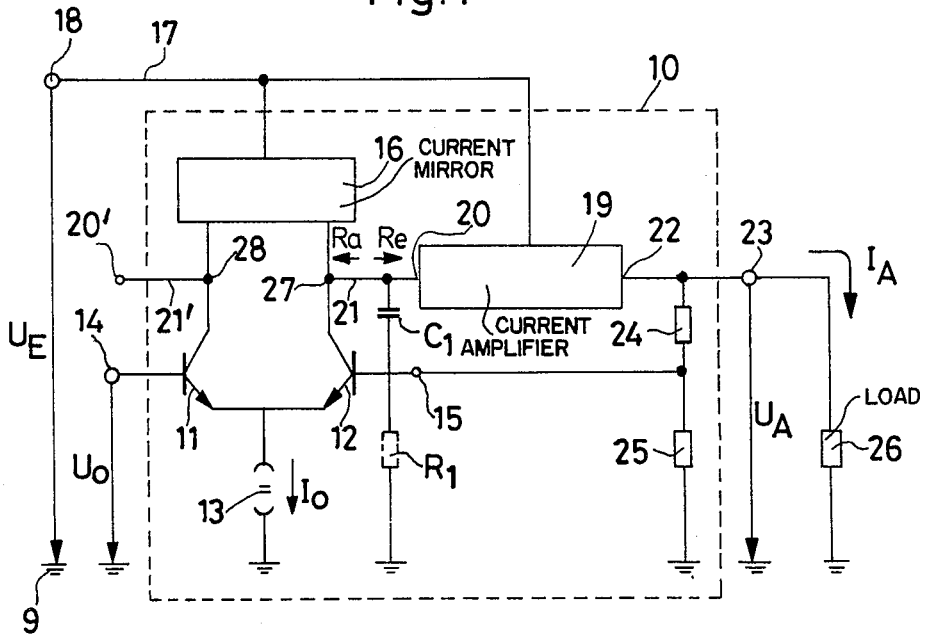
FIG. 1 is a basic diagram of a voltage regulator according to the invention, with its output connected to a load resistor.
Figure 6:
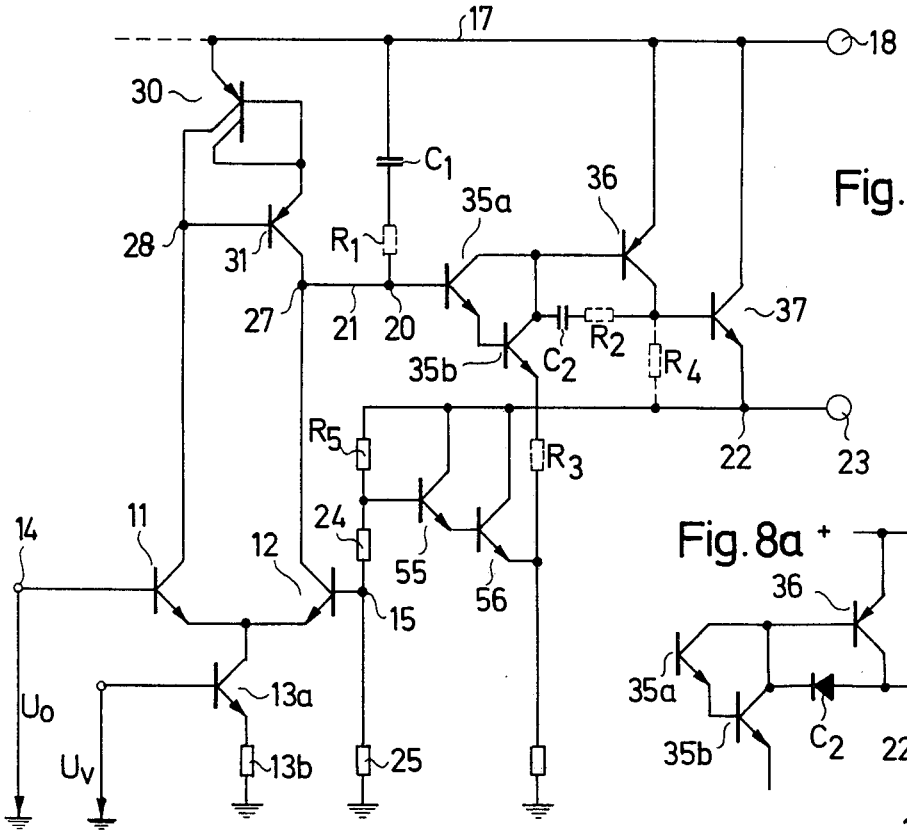
Figure 8A:
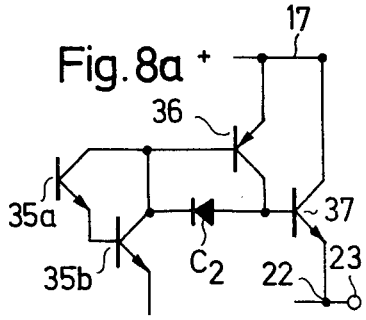
Figure 8B:
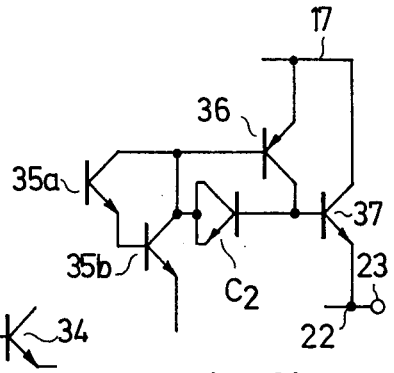
Figure 7A:
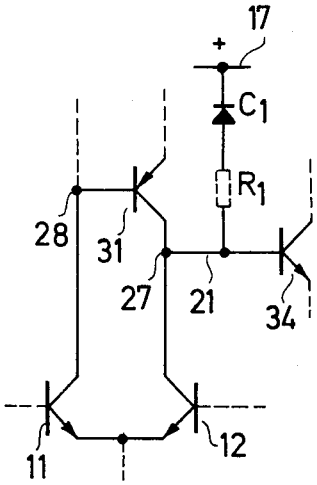
Figure 7B:
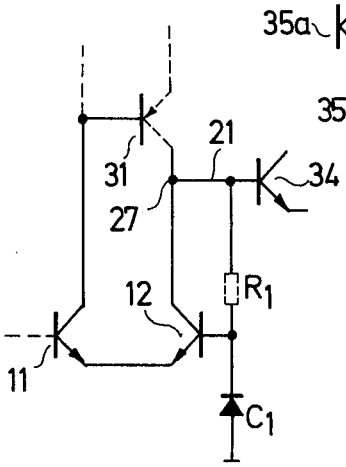

FIGS. 3*a*, 3*b* are illustrative examples of a differential amplifier with a current mirror circuit for output coupling for use in the basic circuit of FIG. 1;

FIGS. 4*a*, 4*b*, 4*c* and 4*d* are examples of a current amplifier circuit with a current inflow input, for use in the basic circuit of FIG. 1;

FIGS. 5*a*, 5*b* and 5*c* are examples of a current amplifier circuit with a current outflow input circuit, for use in a voltage regulator according to the invention;

FIG. 6 is a complete circuit diagram of a voltage regulator in accordance with the invention;

FIGS. 7*a* and 7*b* are circuit diagrams showing ways of connecting a first monolithically integrated capacitor in accordance with the invention, and FIGS. 8*a* and 8*b* are modifications of a current amplifier circuit in accordance with FIG. 4*d*, provided with an additional second monolithically integrated capacitor, respectively in two versions.

The monolithic integrated voltage regulator 10 shown in FIG. 1 comprises a differential amplifier composed of two NPN transistors 11 and 12 with their emitters connected together and further connected through a current source 13 through chassis ground. The base of transistor 11 constitutes the first input 14 and the base of transistor 12 likewise the second input 15 of the differential amplifier. The collectors of the two transistors 11,12 are connected to a current mirror circuit 16, the other side of which is connected to the positive current supply bus 17 that connects a terminal 18 serving for a connection to the integrated circuit unit of a positive supply voltage $U_E$. The voltage regulator 10 further contains a current amplifier circuit 19 likewise connected to the current supply bus 17 and having its input 20 connected by a conductor 21 to the collector of the transistor 12, while its output 22 provides the stabilized output voltage $U_A$ to the output terminal 23. A voltage divider composed of two ohmic resistances 24 and 25 is connected between the output 22 of the current amplifier circuit 19 and ground. The tap of this voltage divider, the common connection of the resistances 24 and 25, is connected to the base of the transistor 12 that forms the second input 15 of the differential amplifier. The base of the transistor 11 that forms the first input of the differential amplifier is connected to the reference voltage $U_o$. The sum current of the differential amplifier that flows between the common emitter connection and ground, is designated $I_o$. A load resistor 26 is shown in FIG. 1 outside the circuit of the voltage regulator 10, connected between the output terminal 23 and ground. The current $I_A$ delivered by the current amplifier circuit 19 flows through the load resistor 26.

The stability condition for the basic circuit of FIG. 1 will first be considered. The loop gain at low frequency for the circuit of FIG. 1 is given by the following expression $$V_o = p \cdot S \cdot \beta R_L, \tag{1}$$

where S designates the steepness of the characteristic of the combination of the differential amplifier and the current mirror circuit, $\beta$ the total current amplification of the current amplification circuit 19 and $R_L$ the resistance value of the load resistance 26.

Figure 2:
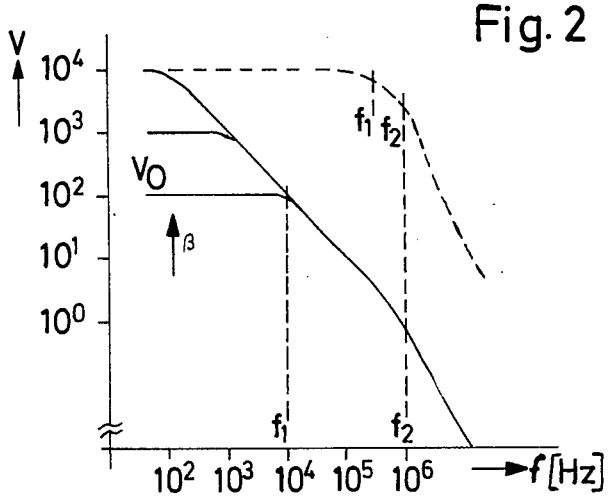
FIG. 2 is a graph of the frequency characteristic of the loop gain of the circuit of FIG. 1, with and without a modifying capacitor.

FIG. 2 shows in graph form the frequency dependence of the loop gain (Bode diagram). In the unmodified state, the "knee" frequencies $f_1$ and $f_2$ lie close to each other, for example at $10^5$ to $10^6$ Hz. At the frequency $f_2$ total phase shift amounts to 360°. Since at this frequency $V > 1$, the circuit is unstable.

The first "knee" frequency $f_1$ must accordingly be made small enough that the amplification is surely $< 1$ in the neighborhood of $f_2$ (e.g., $10^6$ Hz), in order that the circuit may be stable. For this purpose, assuming $f_2$ to be known and equal to $10^6$ Hz, it is necessary that $$f_1 \leqslant \frac{f_2}{V_o}. \tag{2}$$

In general a sufficiently small internal resistance of the regulator is required, which involves the relation $$R_i = \frac{R_L}{V_o}. \tag{3}$$

Hence the requirement regarding $f_1$ becomes $$f_1 \leqslant f_2 \cdot \frac{R_i}{R_L}. \tag{4}$$

For example: $R_L = 100$ ohms, $R_i$ is equal or $< 0.1$ ohms, $f_2 = 1$ MHz gives the result $f_1 < 1$ kHz.

This relatively low "knee" frequency $f_1$ should if possible be realized by a monolithically integratable capacitor $C_1$ having a value equal or $< 20$ pF. To obtain this result the determinative amount of resistance in the delay network in this example must be $$\frac{1}{2\pi f_1 \cdot C_1} > \frac{1}{2\pi \cdot 10^3 \cdot 20 \cdot 10^{-12}}\,\Omega \approx 8\ M\Omega$$

In accordance with the invention the connecting conductor 21 between the differential amplifier output 27 and the current amplifier input 20 is chosen as a particularly high impedance point, more precisely, "high ohm point", of the circuit and hence, an appropriate place for connecting the capacitor $C_1$ as shown in FIG. 1, in series with a resistor $R_1$, to a firmly fixed potential, for example ground.

It is then required that $$R_b = \beta R_L \tag{5a}$$

where $R_a$ is the output resistance of the differential amplifier and $R_b$ is the input resistance of the current amplifier circuit. If it is assumed that the internal resistance of the differential amplifier 11,12 as including the current mirror circuit 16 can be made large compared to the input resistance of the current amplifier circuit 19, hence $R_a >> R_b$, it should then follow that $$R_b > \frac{1}{2\pi f_1 C_1}. \tag{5a}$$

Furthermore:

$$R_b = \beta R_L \tag{6}$$

If the value for $R_b$ given by equation (6) and the value for $f_1$ given by equation (2) are set into equation (5a), it follows that $$\beta R_L > \frac{V_o}{2\pi f_2 C_1}. \tag{7}$$

If the value for $V_o$ from equation (1) is set into equation (7), the result is $$\beta R_L > \frac{p \cdot S \cdot \beta \cdot R_L}{2\pi f_2 \cdot C_1}. \tag{7a}$$

The stability requirement, therefore, can be fulfilled in accordance with the invention in a manner independent of $\beta$ and $R_L$ if only the condition $$1 > \frac{pS}{2\pi f_2 C_1} \tag{8}$$

or $$S < \frac{2\pi f_2 C_1}{p} \tag{8b}$$

is fulfilled. The steepness of the characteristic of the combination of the differential amplifier 11,12 and the current mirror circuit 16 has the value $$S = \frac{I_o}{2 U_T}, \tag{9}$$

where $I_o$ is the sum current of the differential amplifier as designated in FIG. 1 and $$U_T = \frac{K \cdot T}{q} \tag{9a}$$

is the temperature voltage of where K is the Boltzmann constant, T the absolute temperature and $q$ the charge of an electron.

By substituting the expression for S of equation (9) into equation (8b), there is derived the following requirement $$I_o < \frac{4 \pi U_T f_2 C_1}{P}. \tag{10}$$

For example: if $U_T = 26$ mV (room temperature), $f_2 = 1$ MHz, $C_1 = 20$ pF, $p = 0.5$, the result is that $I_o < 13 \mu A$.

An important distinguishing feature of the invention thus lies in the fact that for obtaining stability by means of a relatively small circuit-integratable capacitance $C_1$, the sum current $I_o$ of the differential amplifier 11,12 is made extraordinarily small.

On this basis the requirement previously assumed $$R_a >> R_b \tag{11}$$

is also fulfilled, at least approximately, because the internal resistance of the transistors utilized in the differential amplifier 11,12 and in the current mirror circuit 16 is very high for small collector currents.

It should be noted in FIG. 2 that the frequency characteristic of the circuit modified by the presence of the capacitance $C_1$ is independent of $\beta$ at high frequency. An increase of $\beta$ does indeed raise the amplification $V_o$, but it produces a corresponding reduction of the knee frequency $f_1$.

FIGS. 3*a* to 3*c* show examples of differential amplifiers with output coupled by a current mirror circuit.

The circuit of FIG. 3*a* shows the simplest current mirror circuit, consisting of a single PNP transistor 29 provided with two collectors. The emitter of this PNP transistor is connected to the positive current supply bus 17 that is fed from the terminal 18 (FIG. 1). The base and one of the two collectors of the transistor 29 are connected to the collector of the transistor 11, while the other collector of the transistor 29 is connected to the output conductor 21 and also to the collector of the transistor 12.

The circuit of FIG. 3*b* shows a second form of current mirror circuit that is compensated with reference to current amplification and has a substantially higher internal resistance than the basic circuit shown in FIG. 3*a*. It consists of two PNP transistors 30 and 31. The first transistor 30 has two collectors and its emitter is connected to the positive current supply bus 17. The base and one of the two collectors of this first PNP transistor 30 are connected to the emitter of the second PNP transistor 31, while the second collector of the transistor 30 is connected to the base of the transistor 31 and at the same time to the collector of the transistor 11. The collector of the second PNP transistor 31 is connected to the output conductor 21 and to the collector of the transistor 12.

FIGS. 4*a* through 5*c* show examples of current amplifier circuit. Since the differential amplifier 11,12 has a complementary output 28, i.e. it can supply current or take in current, both types of current amplifiers, that is, those with a current inflow input and those with a current outflow input, may be used to follow the differential amplifier, but if the current taking output of the differential amplifier and a current amplifier with a current outflow input are used, the connections to the inputs 14 and 15 of the differential amplifier, as designated in FIG. 1, must be interchanged.

In FIGS. 4*a* through 4*d* current amplifiers with current inflow inputs are shown.

The current amplifier circuit 19 shown in FIG. 4*a* consists of a single NPN transistor 34 with its collector connected to the positive current supply bus 17. The base of the transistor 34 constitutes the input 20 and the emitter of the transistor 34 constitutes the output 22 of the current amplifier 19. The base electrode, forming the input 20, is accordingly connected over the conductor 21 to the noninverting output 27 (FIG. 1) of the differential amplifier.

As shown in FIG. 4*b* the NPN transistor 34 of FIG. 4*a* can be constituted as a compound transistor of the Darlington type formed of two transistor elements 34*a* and 34*b*. Such a combination of a pair of transistors is a functional equivalent for a single transistor. In this arrangement the base of the first NPN transistor 34*a* supplies the input 20 and the emitter of the second NPN transistor 34*b* supplies the output 22 of the current amplifier 19.

FIG. 4*c* shows a current amplifier composed of three transistors, with the input 20 provided by the base of an NPN transistor 35. The collector of the transistor 35 is connected to the base of a PNP transistor 36, of which the emitter is connected to the positive current supply bus 17 and of which the collector is connected to the base of a second NPN transistor 37. The collector of the second NPN transistor 37 is connected to the positive current supply bus 17. The emitters of the two NPN transistors 35 and 37 are connected together and their common connection forms the output 22 of the current amplifier 19.

As shown in FIG. 4*d*, the NPN transistor 35 can also be constituted as a Darlington compound NPN transistor 35*a*,35*b*. The base of the NPN Darlington transistor provides the input 20 of the current amplifier, while its emitter connection is connected to the second NPN transistor 37 and together with the latter provides the output 22 of the current amplifier 19.

FIGS. 5*a* through 5*c* show current amplifier circuits with current outflow inputs.

FIG. 5*a* shows a current amplifier circuit 19 consisting of a PNP transistor 38 and an NPN transistor 39. The emitter of the PNP transistor 38 is connected to the positive current supply bus 17 and its base constitutes the input 20' of the current amplifier circuit. The collector of the transistor 38 is connected to the base of the NPN transistor 39, while the collector of the latter is connected to the positive current supply bus 17 and its emitter constitutes the output 22 of the current supply circuit. The input 20' of this current amplifier, i.e. the base of the PNP transistor 38, is connected over the conductor 21' to the inverting outputs 28 (FIG. 1) of the differential amplifier.

FIG. 5*b* shows a circuit in which the NPN transistor 39 of FIG. 5*a* is constituted as a Darlington compound transistor 39*a*,39*b*.

FIG. 5*c* shows a current amplifier circuit having two PNP transistors 40 and 41 and two NPN transistors 42 and 43. The emitters of both PNP transistors 40 and 41 are connected to the positive current supply bus 17. The base of the first PNP transistor 40 provides the input 20' of the current amplifier circuit. The collector of the transistor 40 is connected to the base of the first NPN transistor 42, of which the collector is connected to the base of the second PNP transistor 41. Similarly, the collector of the second PNP transistor 41 is connected to the base of the second NPN transistor 43, of which the collector is connected to the positive current supply bus 17. The emitters of the two NPN transistors 42 and 43 are connected together and form the output 22 of the current amplifier circuit 19. In the case of current amplifiers with two or more transistors, the possibility of additional instabilities must be considered, the prevention of which may require a second capacitor $C_2$ in the final stage, as further described below.

FIG. 6 shows the full circuit of an illustrative embodiment of a voltage regulator in accordance with the invention, in this case combining a differential amplifier shown in FIG. 3*b* and a current amplifier circuit similar to that shown in FIG. 4*d*, combined in accordance with the basic diagram given in FIG. 1. The current amplifier circuit 19 in this case consists of a Darlington combination of two NPN transistors 35*a* and 35*b* as an input stage and a comparable Lin circuit combination of a PNP transistor 36 and an NPN transistor 37 as an output or final stage. The emitter of the second NPN transistor 35*b* of the Darlington combination is connected either directly or over a resistor $R_3$ (indicated in dashed lines to show its optional nature) to the emitter of the second transistor 56 of a second Darlington combination composed of two NPN transistors 55 and 56, of which the common collector connection is connected to the output 23 of the voltage regulator 10, hence to a voltage that permits the active operation of this second Darlington combination 55,56. The base of the first transistor 55 of this combination is connected over a resistor $R_5$ with the output 23 of the voltage regulator. The common collector connection of the first Darlington combination 35*a*,35*b* is connected to the base of the PNP transistor 36, which is the first transistor of the final stage. The emitter of the NPN transistor 37 is connected to the output 23 of the voltage regulator. The emitter of the PNP transistor 36 and the collector of the NPN transistor 37 are connected to the positive current supply bus 17.

In the circuit shown in FIG. 6, the emitter of the second Darlington transistor combination 55,56 is at a somewhat lower voltage level than the output voltage $U_A$ and the difference between minimum input voltage and output voltage is as small as possible. A resistor $R_3$ can be interposed between the emitters of the two Darlington transistor combinations 35*a*,35*b* and 55,56, in order to reduce the current amplification of the Darlington stage at low current amplification of the current amplifier circuit, and thereby to prevent nonlinear oscillations.

Furthermore, the circuit point at which the common collector connection of the first Darlington circuit 35*a*,35*b* is connected to the base of the first transistor of the Lin circuit, the PNP transistor 36, can advantageously be connected through a second circuit-integratable capacitor $C_2$ to the base of the NPN output transistor 37, either directly or, if desired, with interposition of a resistor $R_2$. As already mentioned, such a provision is a counter-measure to instabilities that arise in multi-transistor current amplifiers. It is, moreover, advantageous to connect the base and emitter of the NPN transistor 37 of the final stage over a resistor $R_4$ in order to raise the breakdown voltage and to reduce the blocking current. The current source for the differential amplifier can be provided by a transistor 13*a* and a resistor 13*b*, in which case the base of the transistor 13*a* is connected to a bias voltage $U_v$.

FIG. 7*a* illustrates the connection of the first capacitor $C_1$ between the connection conductor 21 and the positive current supply bus 17. This capacitor is of course an element of a monolithic integrated circuit and it can be provided as a diffusion capacitor, i.e. as a base-collector diode, as shown in FIGS. 7*a* and 7*b*. If the voltage on the capacitor is smaller than the breakdown voltage of a base-emitter diode, this form is to be chosen because of the small integrated circuit surface required. $C_1$ can also be made as a so-called MOS capacitor (metallized oxide on diffused semiconductor). It is also possible to combine diffusion and MOS capacitive properties. A base-collector diode can also be used.

The same possibilities hold for the capacitor $C_2$ of FIG. 6, as shown in FIG. 8*a*. If a base-emitter diode is used, even in parallel with a base-collector diode as shown in FIG. 8*b*, when there are short-duration positive voltage pulses on the positive supply voltage bus, as occurs for example, in the case of motor vehicles, the output is pulled up when the diode breaks down. This is an advantageous property of such an embodiment of the invention if the utilization circuit itself is insensitive to voltage pulses, since the utilization circuit loads down the supply voltage through the conducting final stage transistor, and consequently loads down the disturbing voltage pulses which are, in general, coupled to the circuit in a high-impedance fashion.

Although the invention has been described with reference to particular embodiments, it will be understood that variations and modifications are possible within the inventive concept.

We claim:

1. A monolithic integrated voltage regulator for regulating the voltage at which current is supplied from a voltage source ($U_E$) having positive and negative terminals comprising:

a differential amplifier having a first input (14) for connection to a reference voltage source ($U_o$) and having a current mirror circuit (16) coupling its outputs, current amplifier means (19) in the form of a current amplifier with inflowing current having its input (20) connected by a conductor (21) to the non-inverting output (27) of said differential amplifier, said current amplifier means having a voltage divider composed of ohmic resistances (24, 25) connected across its output, with the tap thereof connected to the second input (15) of said differential amplifier (11,12), said current amplifier means further comprising:

an input stage consisting of a first Darlington circuit combination of two NPN transistors (35a,35b);

an output stage comprising a Lin circuit combination of a PNP transistor (36) and an NPN transistor (37), and a second Darlington circuit combination of a first (55) and a second (56)NPN transistors with the emitter of the latter connected through a resistor to said negative terminal of said voltage source and with the common collector connection connected to a voltage that permits active operation of said second Darlington combination (55, 56), the emitter of the second NPN transistor (35b) of the first Darlington circuit being connected at least through a resistor ($R_3$) to the emitter of the second transistor (56) of the second Darlington circuit, the base of the first transistor (55) of said second Darlington combination being connected to said negative terminal by a resistance divider connected between said negative terminal and the output terminal (23) of said voltage regulator, the common collector connection of said first Darlington circuit (35a, 35b) being connected with the base of said PNP transistor (36) of said output stage, the emitter of said NPN transistor (37) of said output stage being connected with said output terminal (23) of said voltage regulator and the emitter of said PNP transistor (36) as well as the collector of said NPN transistor (37) of said output stage being connected with said positive terminal (18) of the voltage source, and a circuit stabilizing capacitor ($C_1$) monolithically integrated into the circuit connected between the said conductor (21) connecting the input of said current amplifier to the noninverting output of said differential amplifier and one of said terminals of said voltage source, the stabilized output voltage ($U_a$) of the voltage regulator (10) being available at said output terminal (23) to which the emitter of said NPN transistor (37) of said output stage is connected.

2. A voltage regulator as defined in claim 1 in which the common collector connection of said first Darlington combination (35a, 35b) is connected with the base of the NPN output transistor (37) of said output stage through a second capacitor ($C_2$) of an electrical magnitude suitable for monolithic integration into the circuit.

3. A voltage regulator as defined in claim 2, in which the base and emitter of the NPN transistor (37) of the output stage are connected to each other over a resistor ($R_4$).

4. A voltage regulator as defined in claim 2 in which said first capacitor ($C_1$) and said second capacitor ($C_2$) are base-collector diodes.

5. A voltage regulator as defined in claim 2 in which said first capacitor ($C_1$) and said second capacitor ($C_2$) are base-emitter diodes.

6. A voltage regulator as defined in claim 2 in which said first capacitor ($C_1$) and said second capacitor ($C_2$) are of the type in which the dielectric is formed by an oxide layer.

7. A voltage regulator as defined in claim 2 in which one of said capacitors ($C_1$,$C_2$) is a base-collector diode and the other is a base-emitter diode.

8. A voltage regulator as defined in claim 1 in which the base and emitter of the NPN transistor (37) of the output stage are connected to each other over a resistor ($R_4$).

9. A voltage regulator as defined in claim 8 in which said first capacitor ($C_1$) is a base-collector diode.

10. A voltage regulator as defined in claim 8 in which said first capacitor ($C_1$) is a base-emitter diode.

11. A voltage regulator as defined in claim 8 in which said first capacitor ($C_1$) is of the type in which the dielectric is formed by an oxide layer.

12. A voltage regulator as defined in claim 8 in which one of said capacitors ($C_1$,$C_2$) is a base-collector diode and the other is a base-emitter diode.

13. A voltage regulator as defined in claim 1 in which said circuit stabilizing capacitor ($C_1$) is a base-collector diode.

14. A voltage regulator as defined in claim 1 in which said circuit stabilizing capacitor ($C_1$) is a base-emitter diode.

15. A voltage regulator as defined in claim 1 in which said circuit stablizing capacitor ($C_1$) is of the type in which the dielectric is formed by an oxide layer.

16. A monolithic integrated voltage regulator for regulating the voltage at which current is supplied from a voltage source ($U_E$) having positive and negative terminals comprising:

a differential amplifier having a first input (14) for connection to a reference voltage source ($U_o$) and having a current mirror circuit (16) coupling its outputs, current amplifier means (19) in the form of a current amplifier with inflowing current having its input (20) connected by a conductor (21) to the noninverting output (27) of said differential amplifier, said current amplifier means having a voltage divider composed of ohmic resistances (24, 25) connected across its output, with the tap thereof connected to the second input (15) of said differential amplifier (11, 12), said current amplifier means further comprising:

an input stage consisting of a first Darlington circuit combination of two NPN transistors (35a,35b);

an output stage comprising a Lin circuit combination of a PNP transistor (36) and an NPN transistor (37), and a second Darlington circuit combination of a first (55) and a second (56) NPN transistors with the emitter of the latter connected through a resistor to said negative terminal of said voltage source and with the common collector connection connected to a voltage that permits active operation of said second Darlington combination (55, 56), the emitter of the second NPN transistor (35b) of the first Darlington circuit being connected at least through a resistor ($R_3$) to the emitter of the second transistor (56) of the second Darlington circuit, the base of the first transistor (55) of said second Darlington combination being connected to the output terminal (23) of said voltage regulator, the common collector connection of said first Darlington circuit (35a, 35b) being connected with the base of said PNP transistor (36) of said output stage, the emitter of said NPN transistor (37) of said output stage being connected with said output terminal (23) of said voltage regulator and the emitter of said PNP transistor (36) as well as the collector of said NPN transistor (37) of said output stage being connected with said positive terminal (18) of said voltage source, and a circuit stabilizing capacitor ($C_1$) monolithically integrated into the circuit connected between the said conductor (21) connecting the input of said current amplifier to the noninverting output of said differential amplifier and one of said terminals of said voltage source, the stabilized output voltage ($U_a$) of the voltage regulator (10) being available at said output terminal (23) to which the emitter of said NPN transistor (37) of said output stage is connected.

* * * * *